US005605297A

United States Patent [19]

Bruns

[11] Patent Number: 5,605,297

[45] Date of Patent: Feb. 25, 1997

[54] DEVICE FOR CONTROLLING YARN BALLOONING AT THE WINDING HEAD OF A BOBBIN WINDING MACHINE

[75] Inventor: Siegfried Bruns, Mönchengladbach, Germany

[73] Assignee: W. Schlafhorst AG & Co., Moenchengladbach, Germany

[21] Appl. No.: 435,412

[22] Filed: May 10, 1995

[30] Foreign Application Priority Data

May 26, 1994 [DE] Germany ..... 44 18 312.7

[51] Int. Cl.[6] ..... B65H 57/00

[52] U.S. Cl. ..... 242/157 R; 57/354; 57/356; 242/157 R

[58] Field of Search ..... 242/157 R, 157 C, 242/128, 171; 57/352, 354, 355, 356

[56] References Cited

U.S. PATENT DOCUMENTS

| | | | |
|---|---|---|---|
| 2,170,194 | 8/1939 | Griggs | 242/128 |
| 2,629,566 | 2/1953 | King | 242/128 |
| 3,043,537 | 7/1962 | Chapman et al. | 242/128 |
| 3,094,835 | 6/1963 | Nimtz et al. | 57/354 |
| 3,203,642 | 8/1965 | Hirst | 242/128 |
| 4,334,653 | 6/1982 | Whellams | 242/128 |
| 5,044,572 | 9/1991 | Grecksch et al. | 242/128 X |

FOREIGN PATENT DOCUMENTS

| | | | |
|---|---|---|---|
| 2380360 | 10/1978 | France | 242/157 R |
| 2205556 | 8/1973 | Germany | 57/354 |
| 262683 | 12/1988 | Germany | 57/354 |
| 6-306711 | 11/1994 | Japan | 57/356 |

*Primary Examiner*—William Stryjewski
*Attorney, Agent, or Firm*—Shefte, Pinckney & Sawyer

[57] ABSTRACT

In the course of rewinding yarn on a bobbin winding machine, the yarn performs a balloon-like oscillation around the delivery bobbin. The shape of the balloon has an effect on the yarn tension force and thus on the behavior of the yarn during winding. To reduce resulting tension fluctuations and particularly tension peaks, the course of yarn travel is influenced by means of a device in accordance with the present invention having an annular yarn guide surface comprised of a first set of guide surfaces collectively forming a part of a truncated cone the larger diameter of which is adjacent the delivery bobbin and a second set of guide surfaces collectively forming converging edges of an at least five-sided truncated pyramid with each pyramidal edge being disposed to extend axially between two adjacent first guide surfaces forming recessed notches in their collective conical surface. The conicity of the truncated cone and of the truncated pyramid extending in the same direction with coinciding axes to arrange the first and second guide surfaces symmetrically with respect to one another.

5 Claims, 4 Drawing Sheets

DEVICE FOR CONTROLLING YARN BALLOONING AT THE WINDING HEAD OF A BOBBIN WINDING MACHINE

FIELD OF THE INVENTION

The present invention relates to a device for controlling the travel of yarn, particularly its ballooning, at the winding head of a bobbin winding machine in which yarn is unwound from a delivery bobbin and then rewound onto a take-up bobbin, wherein the device is disposed above the delivery bobbin.

BACKGROUND OF THE INVENTION

When yarn is rewound on a bobbin winding machine from a cop-wound delivery bobbin to a take-up bobbin, the yarn oscillates in a balloon shape when being drawn off the delivery bobbin and in addition performs a lengthwise motion like that of the spinning rail of a ring spinning machine because of the truncated cone-like deposit of the yarn on the yarn package by the spinning rail on the spinning frame. On the topmost end of the delivery bobbin, the yarn always wanders from the tube to the exterior circumferential yarn surface, in the course of which the balloon diameter changes from narrow to wide. The yarn moves with the greatest speed at the circumferential surface of the delivery bobbin and therefore forms the most distended balloon.

The yarn oscillating in a balloon shape has an effect on the force to be provided for pulling the yarn off the delivery bobbin. Balloons which oscillate particularly extensively exert a great tensile force on the yarn. For this reason attempts have been made for some time to exert an effect on the behavior of the yarn being unwound off the delivery bobbin.

While the intention initially was to suppress the formation of the balloon altogether, as disclosed in German Published, Examined Patent Application DE-AS 11 78 337 and Swiss Patent 362 350, later attempts tried to have an effect on the shape of the balloon, as disclosed in U.S. Pat. No. 3,718,296.

With increasing winding speeds, the influence on the balloon formation as described in the mentioned references loses its effect. While winding speeds of 200 to 500 meters had been considered to be great progress at the time these suggestions were made, currently conventional winding speeds already exceed 1500 meters per minute. The danger that loops can be withdrawn from the cop-wound delivery bobbins at these high speeds is therefore considerably greater. Loops are always generated when one or more yarn windings are withdrawn as a whole from the yarn package without a yarn turn being unwound by means of the yarn moving around the circumference of the yarn package. If such yarn loops encounter so-called "balloon breakers", interlacing of the yarn typically occurs and the yarn breaks.

SUMMARY OF THE INVENTION

It is accordingly an object of the present invention to influence the unwinding properties of yarn from a cop-wound delivery bobbin such that a reduced incidence of yarn looping, breaks or other balloon related problems are encountered even at high winding speeds.

This object is achieved in accordance with the present invention by providing a device disposed above the delivery bobbin at a winding head of a bobbin winding machine for influencing unwinding travel of the yarn as it is unwound axially endwise off the delivery bobbin and rewound onto a take-up bobbin. According to the present invention, the device comprises a substantially annular body having an annular interior yarn guide surface defining an axial opening for travel of the yarn therethrough. The annular yarn guide surface has a first set of guide surfaces collectively forming a part of a truncated cone the larger diameter of which is adjacent the delivery bobbin and a second set of guide surfaces collectively forming converging edges of an at least five-sided truncated pyramid with each pyramidal edge being disposed to extend axially between two adjacent first guide surfaces forming recessed notches in their collective conical surface. The conicity of the truncated cone and of the truncated pyramid extend in the same direction with coinciding axes to arrange the first and second guide surfaces symmetrically with respect to one another.

The invention is based not on the removal of ballooning, such as is taught, for example, in German Published, Examined Patent Application DE-AS 11 78 337, nor on breaking the balloon, such as is taught, for example, in U.S. Pat. No. 3,718,296, but instead contemplates permitting the yarn to oscillate while providing a guide surface for the yarn which influences its ballooning motion. Thus, the device of the present invention acts as a "yarn unwinding accelerator" instead of a "balloon breaker". In accordance with the invention, the yarn guide surface partially has the shape of a truncated cone with its greater diameter facing the delivery bobbin and partially has the shape of a truncated pyramid whose converging edges penetrate through the truncated conical surface to form notches in the conical surface. The conicities of the truncated cone and the truncated pyramid point in the same direction and their axes coincide to orient the conical and pyramidal surfaces symmetrically. The pyramid preferably is an equilateral pyramid with at least five sides.

In contrast to conventional unwinding accelerators, the device of the invention advantageously operates as an unwinding accelerator to control the formation of the normal yarn balloon without destroying or completely suppressing the yarn balloon. This result is accomplished by the notched conical yarn guide surface described above. Viewed in the direction of yarn unwinding from the bobbin, the yarn strikes and moves along the wall surface of the truncated cone until it encounters a pyramidal penetration at which the yarn movement is briefly stopped by the impact of the yarn on one of the pyramidal surfaces causing the course of movement of the yarn to be disturbed but without being abruptly stopped for an extended time or being completely thrown out of its ballooning motion. The interruption of the course of the movement of the yarn can be compared to a brief tucking or restriction on the balloon, so that the yarn cannot develop extreme oscillations at the unwinding point on the cop of the delivery bobbin, and therefore the unwinding forces acting on the yarn because of the centrifugal forces cannot become too great. Because the yarn is only briefly disturbed in its course of movement in the unwinding accelerator, the yarn continues to oscillate in the ballooning fashion, even though it was disturbed, and in this way loosens the yarn windings from the surface of the yarn package.

As indicated, the truncated pyramidal surface is preferably equilateral whereby the distribution of the pyramidal notches is evenly disposed about the truncated cone and therefore achieves a uniform effect of the unwinding yarn. Furthermore, an unwinding accelerator designed in this way can be used for p- as well as q-bobbins.

According to a further aspect of the invention, the conicities of the truncated cone and the truncated pyramid are selected according to the yarn mass. Essentially, as the yarn mass increases, the conicities of the guide surfaces should increase. More bulgy yarn balloons are formed with larger yarn masses, so that the yarn should enter into the yarn unwinding accelerator at a shallower angle than with a lighter yarn which, because of its ballooning characteristics, should enter at a steeper angle. With a detrimental adjustment of the conicity to the yarn mass, e.g., with too steep a cone angle, massive constrictions of the balloon and thus a disadvantageous suppression of the yarn balloon or breaking of the yarn can occur, which would result in the collapse of the yarn balloon.

In a further feature of the invention, the annular extent of the surfaces of the notches formed by the truncated pyramidal surfaces should be no larger than the annular extent of the truncated conical portions. In this manner, the notches formed by the truncated pyramidal surfaces are prevented from penetrating too much into the collective conical surface. In addition, the intended interferences with the yarn balloon do not become so great that the yarn balloon collapses completely and the yarn winds around the tube. The pyramidal notches must be designed in such a way that at their juncture with the adjacently following truncated conical surfaces, as viewed in the running direction of the yarn, an imaginary tangent line on the conical surface intersects the oppositely located surface of the adjoining notch at an obtuse angle, so that an abrupt change in direction of the impinging yarn is avoided.

With unwinding accelerators whose surfaces are exclusively straight, e.g., triangular or square yarn guide tubes, there is the danger that the ballooning yarn, which performs a circular movement, is subjected to large frictional forces because of rubbing against the walls on account of the straight movement forced on it. Furthermore, with abrupt changes in yarn movement because of the triangular or square embodiment of these "unwinding accelerators", the yarn is subjected to strong braking forces at the time of the direction change. The yarn is subjected to considerably weaker forces because of the essentially gentler changes in yarn movement in the yarn unwinding accelerator in accordance with the present invention. This effect is particularly the case where the cross-sectional shape of the truncated pyramid is an equilateral pentagon producing five notches evenly distributed over the circumference of the conical surface to provide the advantage that the faces of the notches are arranged at an obtuse angle in respect to each other and therefore the respective impingement surface of the yarn is at an obtuse angle in respect to the tangent line at the circumferential surface of the truncated cone at the transition point with the notch. Furthermore, a pentagon offers a sufficient number of interference points for the rotating yarn, since as a rule not all notches contribute to the interference with the yarn's ballooning during its oscillation.

DETAILED DESCRIPTION OF THE PREFERRED EMBODIMENTS

Figure 1:
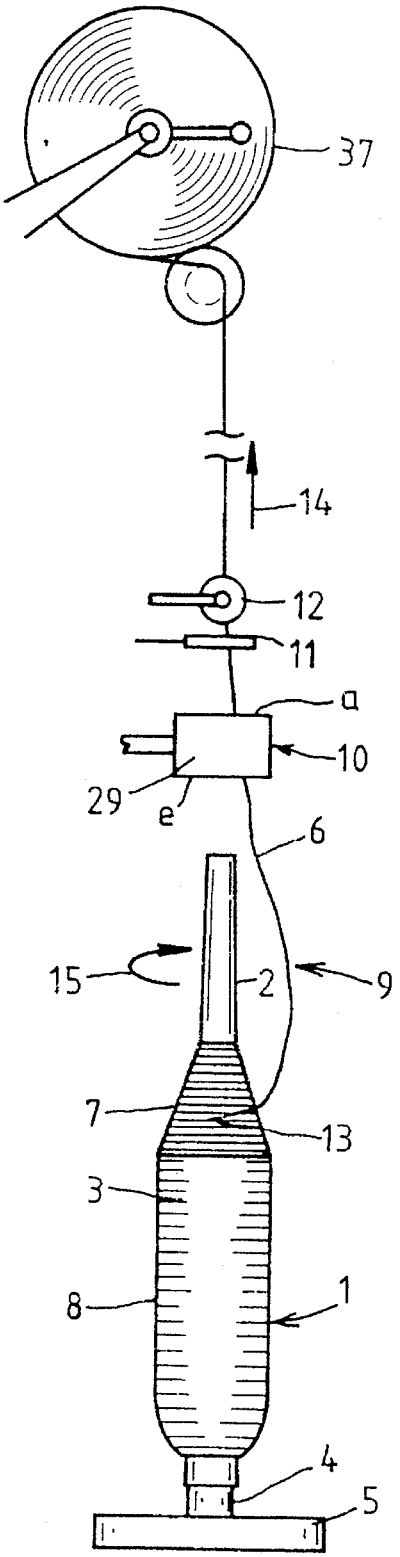
FIG. 1 is an elevational view of a cop-wound delivery bobbin in the unwinding position with the yarn being drawn off upwardly and with the device of the present invention disposed above the delivery bobbin for affecting the course of the yarn travel.

Referring now to the accompanying drawings and initially to FIG. 1, a delivery bobbin 1 wound with yarn in a cop-type fashion, is in the yarn withdrawal, i.e., unwinding, position in a winding head or station of a bobbin winding machine, not shown in detail but known from the prior art. The delivery bobbin 1 includes a yarn tube 2 on which a yarn package 3 is wound, the tube 2 being placed on an arbor 4 of a transport pallet 5. The yarn 6 is withdrawn from the delivery bobbin 1 in the direction of the arrow 14 and is transported to a take up bobbin 37 on which it is wound in a known manner. As shown, the yarn is pulled endwise from the yarn package off the cone-shaped tip 7 of the yarn package 3. Because of the motion of the spinning rail of the ring spinning machine during spinning, the yarn is deposited in adjacent windings on the cone-shaped tip 7 of the yarn package 3 and, in the course of being withdrawn, it continuously wanders back and forth between the tube 2 and the circumferential surface of the non-conical portion 8 of the yarn package 3 in accordance with its deposition during the spinning process.

In the course of this unwinding movement the yarn performs an oscillating motion around the tube 2 forming a so-called yarn balloon 9. The development of the yarn balloon 9 is influenced with the aid of a device 10, sometimes called an unwinding accelerator, situated immediately above the end of the yarn tube 2 for affecting the course of the yarn at the winding head. The yarn 6 enters the device 10 from an inlet side e at the bottom face of the device and leaves it again at an outlet side a at the top of the device. A yarn precleaner 11 and a yarn tensioner 12 are disposed above the winding accelerator. Rough yarn errors and loops are caught in the precleaner as is conventional.

If it is not affected by the so-called unwinding accelerator 10, the yarn balloon 9 oscillates between the point 13 at which the yarn 6 detaches from the yarn package 3 and the first yarn guide point, in this case the precleaner 11. With a yarn withdrawn in the direction 14 from a p-wound delivery bobbin 1, the yarn balloon 9 oscillates in a clockwise direction 15.

Figure 2:
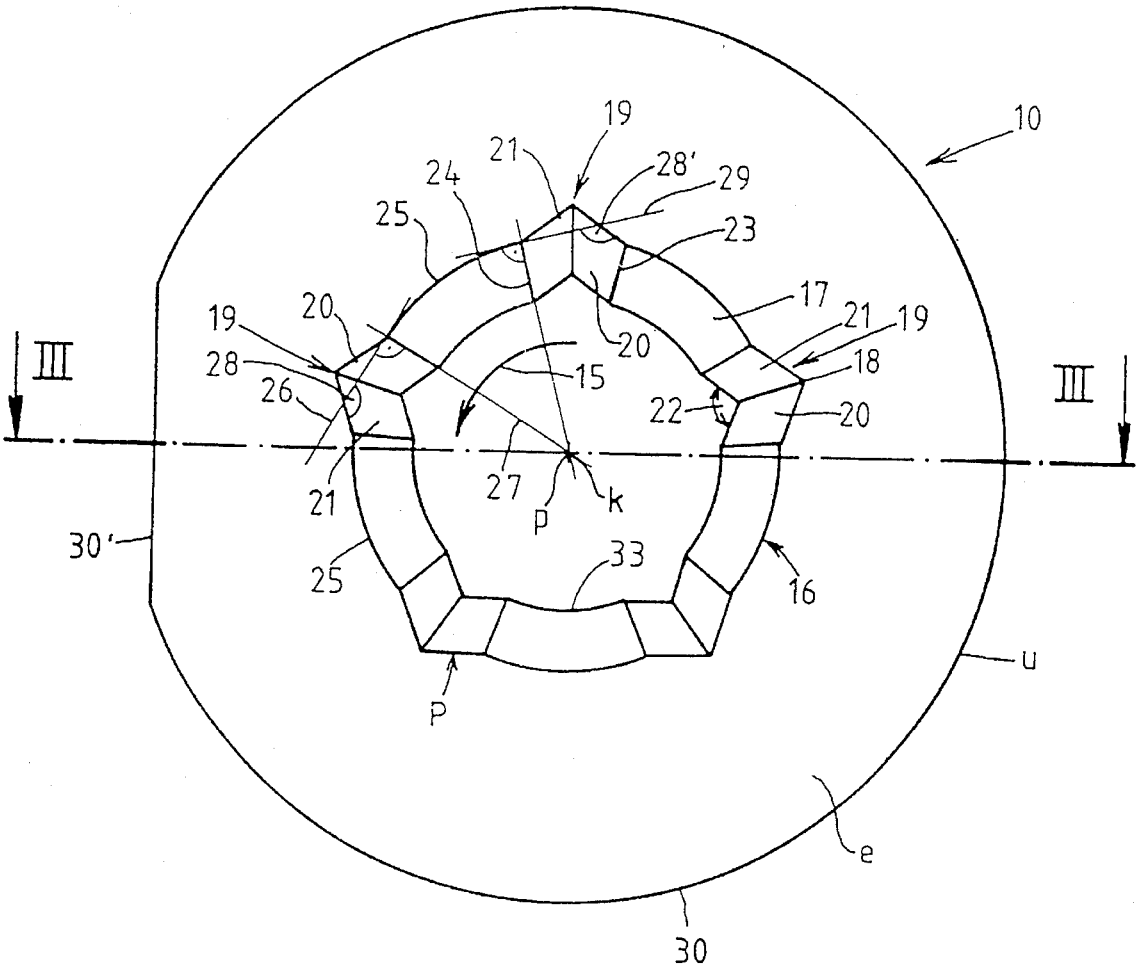
FIG. 2 is a plan view of the inlet side for the yarn of the device of the present invention.
Figure 3:
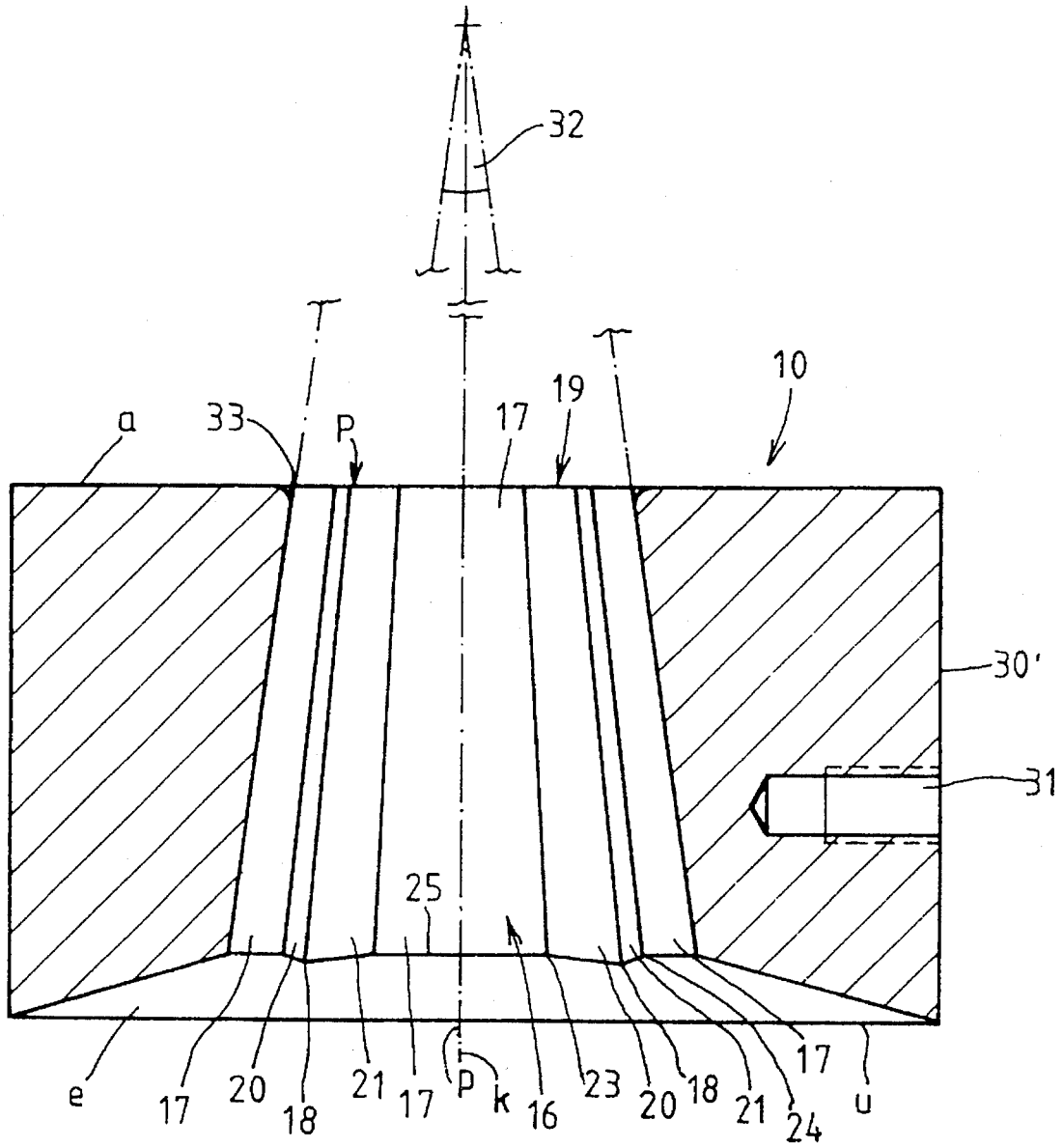
FIG. 3 is an axial cross-section through the present device of FIG. 2, taken along section line III—III of FIG. 2.

The details of the unwinding accelerator device 10 for affecting the course of travel the yarn are represented in FIGS. 2 and 3. FIG. 2 is a view of the so-called yarn unwinding accelerator from the inlet underside e of the device, i.e. from the direction of yarn travel from the delivery bobbin.

The yarn unwinding accelerator 10 of the present exemplary embodiment consists of an annularly shaped solid block of material, preferably aluminum, through which a central axial opening defined by desirably contoured interior surfaces 16 is formed for affecting the ballooning motion of the yarn. In place of a solid block it would also be possible to provide an appropriately shaped metal plate which encloses the contour 16 cut into the solid part from the outside.

As can be clearly seen from FIGS. 2 and 3, the central area of material of the solid block is initially removed in a conical shape, so that the inner contour 16 primarily forms an envelope 17 in the shape of a truncated cone. This truncated conical envelope 17 is then penetrated symmetrically by notches 19 collectively forming the edge portions 18 between the faces of a truncated five-sided equilateral pyramid P oriented such that the edge portions 18 of the truncated pyramid uniformly penetrate the envelope of the truncated cone. As can be seen in FIG. 3, the axes of symmetry p of the pyramid and k of the cone coincide. A uniform penetration of the pyramid edges 18 through the envelope 17 of the truncated cone is thusly assured. A further requirement for even penetration of the pyramidal notches in the conical surface is a coincidental conicity of the cone and the pyramid. In the present exemplary embodiment, the cone angle is 16° and the angle between a pyramid edge 18 and the axis of symmetry k of the pyramid is 10°. Different conicities, for example a steeper envelope surface of the cone, which leads to a deeper penetration of the notches caused by the pyramid edges into the envelope of the cone at the inlet side of the device than at the outlet side, do not improve the withdrawal properties of the yarn.

Each adjoining pair of side faces 20, 21 of the pyramid P converge at a pyramid edge 18 which results in a notch 19 in the envelope 17 of the truncated cone. Taken together, the surfaces 20 and 21 of each edge portion of the truncated pyramid which penetrates the conical envelope 17 to form a notch 19 are maximally of the same size as the adjacent portions of the envelope of the truncated cone between two adjacent notches 19. Since the cross-sectional surfaces formed by the envelope of the truncated pyramid P are equilateral odd-numbered polygons, every two adjacent surfaces 20 and 21 of the envelope of the truncated pyramid enclose between them an obtuse angle 22 of more than 90°. Three and four sided pyramids are not preferred so that triangles and squares are excluded as cross-sectional surfaces.

The notches 19 have been selected such that a yarn moving along a surface 17 of the conical envelope impinges, depending on the direction of rotation of the yarn, on one of the surfaces 20 or 21 as the yarn is moved tangentially past the following one of the contour edges 23, 24 formed between the surfaces 17 of the truncated conical envelope and the pyramidal notches 19.

The above explained operation of the impingement of the yarn is more fully understood with reference to FIG. 2 at the lower edge contour 25. An imaginary tangent line 26 is shown extending perpendicularly in relation to the radius 27 of the cross-sectional surface of the truncated cone at one intersecting contour edge 23, 24 between the conical envelope and the pyramidal envelope in the inlet e of the yarn, and impinges at an obtuse angle 28 on the surface 21 of a notch 19. In contrast to known unwinding accelerators with a triangular or square cross-sectional surface, the yarn is not deflected at right angles to its direction of movement, such as is the case with a square guide tube nor, as is the case with a triangular guide tube, is the yarn deflected in a direction which has a component opposite to the actual direction of rotation of the yarn. If a yarn whose balloon oscillates in the direction of rotation 15, as can be seen in FIG. 1, impinges on the surface 21 of a notch 19, the yarn is deflected out of its actual direction of movement, but the balloon does not collapse completely. Thus, the yarn can still be detached by means of an oscillating, i.e., ballooning, movement from the cone-shaped tip 7 of the yarn body.

If the yarn rotates in the direction opposite the balloon oscillating direction 15 shown, it impinges on a surface 20 of a notch 19 when it tangentially moves past the contour edge 24. A tangent line 29 to the conical contour 25 where the contour edge 24 meets the conical contour 25, impinges on the surface 20 at an obtuse angle 28'. As will be seen, the angles 28 and 28' are of the same size. In this way, the present contour of the unwinding accelerator 10 is suitable for influencing the traveling course of the yarn during unwinding from q-bobbins as well as from p-bobbins under the same conditions.

It can be seen in FIG. 2 that the predominant extent of the outer surface 30 of the unwinding accelerator 10 is cylindrical with a relatively small extent of its circumference flattened at 30'. As can be seen from FIG. 3, a threaded bore 31 for fastening the unwinding accelerator 10 at the winding head is located at the flattened area 30'.

It can furthermore be seen in FIG. 2 that the inner contour 16 does not have an inlet slit for lateral introduction of the yarn. Therefore, with an unwinding accelerator in accordance with the present exemplary embodiment of FIGS. 1–3, it is required to thread the yarn axially through the inner contour 16, e.g., by pneumatic aids blowing from the direction of the yarn inlet side e and/or by suction from the direction of the yarn outlet side a.

FIG. 3 shows a cross-sectional view of the inner contour 16 along the section line III—III indicated in FIG. 2. The coinciding conicity of the envelope 17 of the truncated cone and of the truncated pyramid P penetrating it can be clearly discerned. The axes k of the cone and p of the pyramid coincide. As previously mentioned, in the present exemplary embodiment the conical angle 32 of the cone is 16°.

It can be additionally seen in FIG. 3 that the radial face of the unwinding accelerator 10 at the yarn inlet side e has a recess in the form of a truncated cone with a considerably larger conicity than the envelope of the truncated cone of the inner contour. The lower edge 25 of the inner contour 16 thus does not coincide with the lower edge u of the unwinding accelerator 10. The upper edge 33 of the inner contour 16, however, coincides with the top radial surface, i.e., the outlet side a, of the unwinding accelerator 10.

Rather than the truncated conical shape shown in the drawings, the inlet face e may also be embodied to be of a spherical or otherwise rounded cup-shape. The inlet side e functions in particular for directing the insertion of the yarn during blowing or aspiration upwardly into and through the contoured opening 16 of the unwinding accelerator 10 and, during ongoing operation, the inlet side e, by its disposition ahead of the actual inner contour 16, prevents looping of the yarn around the edge of the lower edge contour 25. It will thus be understood that the lower edge contour 25 as well as the upper edge contour 33 preferably are rounded rather than sharp-edged for protecting the yarn.

Figure 4:
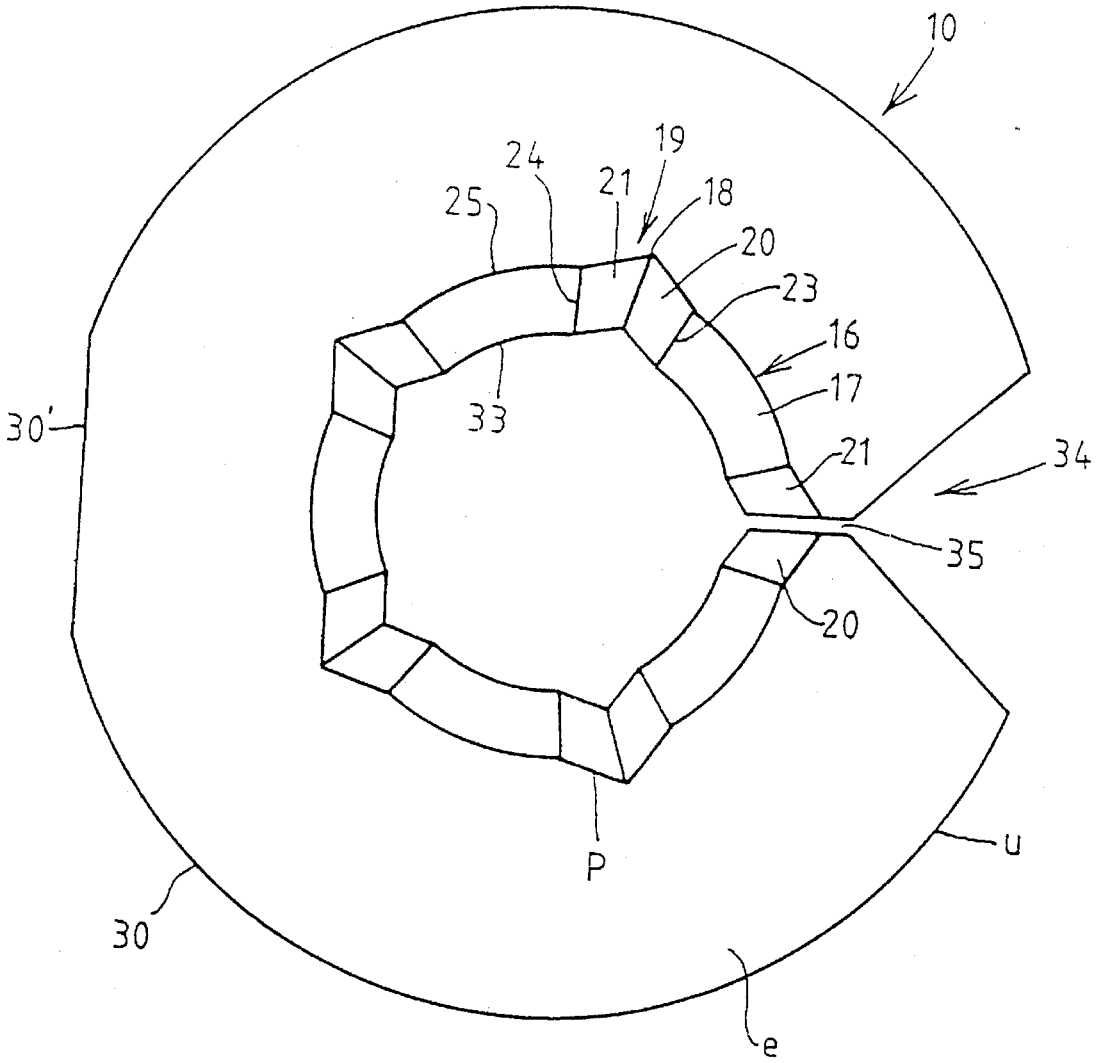
FIG. 4 is another plan view similar to FIG. 2, showing an alternative embodiment of device in accordance with the present invention having a radial insertion slit for the yarn.

FIG. 4 shows another embodiment of the unwinding accelerator 10, wherein the design of the inner contour 16 agrees with the one in the exemplary embodiment represented in FIGS. 2 and 3 but the annular body of the device is modified to provide for lateral insertion of the yarn rather than pneumatic axial yarn insertion. If the yarn is not blown by means of pneumatic aids through the inner contour 16 of the unwinding accelerator 10, but is caught by means of a gripper tube above the cop 1 and below the unwinding accelerator 10 and is inserted by means of the gripper tube into the unwinding accelerator 10, the unwinding accelerator 10 may be configured with an insertion funnel 34 on its circumferential contour 30, which terminates in a slit 35 which should essentially not exceed the yarn thickness. In the present exemplary embodiment the slit 35 terminates in the inner contour 16 at a point where an edge 18 of the pyramid would be located, i.e. where two surfaces 20 and 21 of the truncated pyramid converge. At this location, there is little danger that the yarn which circulates inside the inner contour 16 would escape outwardly through the slit 35.

Devices for affecting the course of the yarn at the winding head of a bobbin winding machine in accordance with the present invention preferably have the following dimensions, which can be adjusted to the yarn travel speed and the yarn mass: the cone angle 32 of the envelope 17 of the truncated cone lies between 15° and 60°; the inclination of the truncated pyramid surfaces lie between 5° and 35°, preferably at 8°; the diameter of the opening formed by the envelope 17 of the truncated pyramid in the yarn outlet side a lies between 20 mm and 45 mm, preferably at 30 mm; and the height of the yarn unwinding accelerator lies between 20 mm and 70 mm, preferably at 40 mm.

Peak increases of the yarn tension occurring during rewinding are considerably reduced by means of the unwinding accelerator of the invention. For example, if polyester yarn is being wound, peak loads in the range of 80 cN to 120 cN can occur at more than proportional frequency, in particular in connection with a triangular unwinding accelerator. Peak values in the range between 100 cN to 120 cN have been lowered to a negligible number when an unwinding accelerator in accordance with the present invention is used. Although more peak values in the range between 40 cN and 80 cN occur with the present invention than with a triangular unwinding accelerator, the present invention still causes the forces acting on the yarn to be considerably decreased. Thus, it is the nature of the present invention to reduce the height of the tension peaks into a range where their effect on the unwinding properties and the quality of the yarn is considerably reduced.

What is claimed is:

1. A device for influencing unwinding travel of a yarn at a winding head of a bobbin winding machine wherein the yarn is unwound axially endwise off a delivery bobbin and rewound onto a take-up bobbin, the device being disposed above the delivery bobbin and comprising a substantially annular body having an annular interior yarn guide surface defining an axial opening for travel of the yarn therethrough, the annular yarn guide surface having a first set of curved guide segments and a second set of angled guide segments alternating annularly with one another, each of the curved guide segments being tapered to collectively define a truncated cone having a larger diameter adjacent the delivery bobbin and each of the angled guide segments being tapered to collectively define a truncated pyramid having a larger transverse dimension adjacent the delivery bobbin, the truncated cone and the truncated pyramid having respective axis which coincide.

2. A device in accordance with claim 1, wherein the annular dimension of the second angled guide segments are no greater than approximately equal to the annular dimension of the first curved guide segments.

3. A device in accordance with claim 1, wherein the tape of the truncated cone and the taper of the truncated pyramid are selected in relation to the mass of the yarn to be greater as the yarn mass increases.

4. A device in accordance with claim 1, wherein each second angled guide segment has two angularly intersecting planar faces, and an imaginary line taken tangent to one of the first curved guide segments at its juncture with one planar face of the adjacent second angled guide segment viewed in the direction of yarn movement intersects the other planar face of the adjacent second angled guide segment at an obtuse angle.

5. A device in accordance with claim 1, wherein the pyramid comprising the second angled guide segments is an equilateral five-sided pyramid whose cross-section is a pentagon.

* * * * *